US008136459B2

(12) United States Patent
Buckland et al.

(10) Patent No.: US 8,136,459 B2
(45) Date of Patent: Mar. 20, 2012

(54) DESK WITH BOOK HOLDER

(75) Inventors: Sam W Buckland, Encino, CA (US); Jessie Rose Chipps, Sherman Oaks, CA (US); Julian Neal Cohen, New York City, NY (US); Julia Smartt Coley, North Hollywood, CA (US); Matthew Aaron Davidson, Encino, CA (US); Philip Hiroaki DeZonia, Los Angeles, CA (US); Noah Harrison Fradin, Studio City, CA (US); Sydney Michele Goldman, Van Nuys, CA (US); Margaret Anne Havunjian, Los Angeles, CA (US); Jonathan Thomas Losk, Sherman Oaks, CA (US); Narendra Nayan Nayak, New York, NY (US); Dina Ziba Saleh, Encino, CA (US); Maximilian Isao Wood, Los Angeles, CA (US); Simona J. Zappas, Sherman Oaks, CA (US)

(73) Assignee: Oakwood School, North Hollywood, CA (US)

( * ) Notice: Subject to any disclaimer, the term of this patent is extended or adjusted under 35 U.S.C. 154(b) by 12 days.

(21) Appl. No.: 12/852,491

(22) Filed: Aug. 8, 2010

(65) Prior Publication Data

US 2012/0031309 A1 Feb. 9, 2012

(51) Int. Cl.
*A47B 1/04* (2006.01)

(52) U.S. Cl. ..... 108/69; 108/90; 248/918

(58) Field of Classification Search ..... 108/90, 108/70, 69, 72, 50.01, 50.02, 152, 26, 65; 248/918, 447, 457, 444; 312/223.1, 223.2, 312/223.3

See application file for complete search history.

(56) References Cited

U.S. PATENT DOCUMENTS

| | | | | | |
|---|---|---|---|---|---|
| 388,972 | A | * | 9/1888 | Hollidge | 248/457 |
| 2,273,006 | A | * | 2/1942 | Carlson | 108/69 |
| 3,054,651 | A | | 9/1962 | King | |
| 4,109,889 | A | | 8/1978 | Durket | |
| D272,496 | S | | 2/1984 | Kemp, III | |
| 4,646,654 | A | * | 3/1987 | Sullivan | 108/69 |
| 4,653,817 | A | | 3/1987 | Sheffer | |
| 5,147,090 | A | * | 9/1992 | Mandell et al. | 248/910 |
| 5,601,270 | A | * | 2/1997 | Chen | 248/454 |
| 5,628,483 | A | * | 5/1997 | Smith et al. | 248/918 |
| 5,671,686 | A | * | 9/1997 | Hurley et al. | 108/26 |
| 5,709,157 | A | * | 1/1998 | Hanusiak | 108/78 |
| 5,715,761 | A | * | 2/1998 | Frattini | 108/50.02 |
| D401,438 | S | | 11/1998 | Acinapura | |
| 5,836,560 | A | * | 11/1998 | Kaplan et al. | 248/918 |
| 5,876,002 | A | * | 3/1999 | White et al. | 248/118 |
| 5,890,782 | A | | 4/1999 | Alberts | |
| 5,944,292 | A | * | 8/1999 | Roman | 248/918 |

(Continued)

*Primary Examiner* — Jose V Chen

(74) *Attorney, Agent, or Firm* — Brian Pangrle; Jonathan T. Losk

(57) ABSTRACT

A desk including a book holder positioned at a predetermined angle relative to the surface of the desk. In one embodiment the book holder is deployable, and the desk surface includes a recess into which the deployable book holder fits when the deployable book holder is in the closed position. The recess optionally includes a rubber surface to avoid slipping of the bottom edge of a book (such as a text book) when the book is being held up with the deployable book holder. In another embodiment a deployable book holder includes an aperture, and a recess includes an island. In various embodiments, a proximal end of a desk surface, closest to where a user sits, may be wider than the distal end to provide adequate arm room for the user.

11 Claims, 11 Drawing Sheets

U.S. PATENT DOCUMENTS

| | | | | |
|---|---|---|---|---|
| 6,131,522 | A * | 10/2000 | Chavez | 108/90 |
| 6,471,164 | B2 * | 10/2002 | DiOrio | 108/69 |
| D470,349 | S | 2/2003 | Risdall | |
| D474,356 | S | 5/2003 | Bosman | |
| D496,537 | S | 9/2004 | Monsalve | |
| 6,992,882 | B2 * | 1/2006 | Wang | 248/918 |
| 7,059,576 | B2 * | 6/2006 | Chen et al. | 248/371 |
| 7,147,284 | B2 | 12/2006 | Mills | |
| 7,216,445 | B2 * | 5/2007 | Bruegmann | 248/454 |
| 7,522,411 | B2 * | 4/2009 | Haglund | 248/918 |
| 2002/0170470 | A1 * | 11/2002 | Cheng | 108/69 |
| 2003/0001064 | A1 * | 1/2003 | Book | 248/454 |
| 2009/0166504 | A1 * | 7/2009 | Lorenzatti | 248/454 |
| 2011/0018407 | A1 * | 1/2011 | Liu | 312/223.1 |

* cited by examiner

DESK WITH BOOK HOLDER

FIELD

The present disclosure relates generally to desks. In particular, but not by way of limitation, the present disclosure relates to desks that may be used in classrooms.

BACKGROUND

The typical classroom desk is confining and not very adaptable to the user's needs. In particular, the typical student desk lacks sufficient desk surface to accommodate a text book (which the student is referencing) and a notebook in which the student is writing. The present disclosure features a desk that can accommodate both.

SUMMARY

Illustrative embodiments are shown in the drawings and summarized below. These and other embodiments are more fully described in the Detailed Description section. It is to be understood, however, that there is no intention to limit the scope of the claims to the forms described in this Summary or in the Detailed Description. One skilled in the art can recognize that there are numerous modifications, equivalents, and alternative constructions that fall within the spirit and scope of this disclosure as expressed in the claims.

One illustrative embodiment includes a desk having a trapezoidal-shaped surface to provide adequate arm space for the user in a space-efficient manner to improve user ergonomics and reduce congestion in, for example, a classroom.

Another illustrative embodiment includes a deployable book holder that extends upward from the desk surface upon which a book, such as a text book, can be positioned.

In an illustrative embodiment a book holder is deployable, and the desk surface includes a recess into which the deployable book holder fits when the deployable book holder is in the closed position. The recess optionally includes a rubber surface to avoid slipping of the bottom edge of a book (such as a text book) when the book is being held up with the deployable book holder. In another illustrative embodiment, a deployable book holder includes an aperture, and a recess includes an island. When in the closed position, the island protrudes through the aperture of the deployable book holder to form a relatively flat and uniform desk surface. In such an example, when the deployable book holder is in the open, or deployed, position, the island physically protrudes above the recess, thereby providing a ledge against which the bottom edge of a book, such as a text book, may rest securely. The ledge may also serve to hold the pages of an open book by inhibiting undesired flipping of the pages.

The above-described objects and features as well as other objects, features, and advantages of the present disclosure are readily apparent from the following detailed description of the best mode for carrying out technologies disclosed herein, when taken in connection with the accompanying drawings.

BRIEF DESCRIPTION OF THE DRAWINGS

Various objects and advantages, and a more complete understanding of the present disclosure are apparent and more readily appreciated by reference to the following Detailed Description and to the appended claims when taken in conjunction with the accompanying Drawings, wherein:

DETAILED DESCRIPTION

Figure 1:
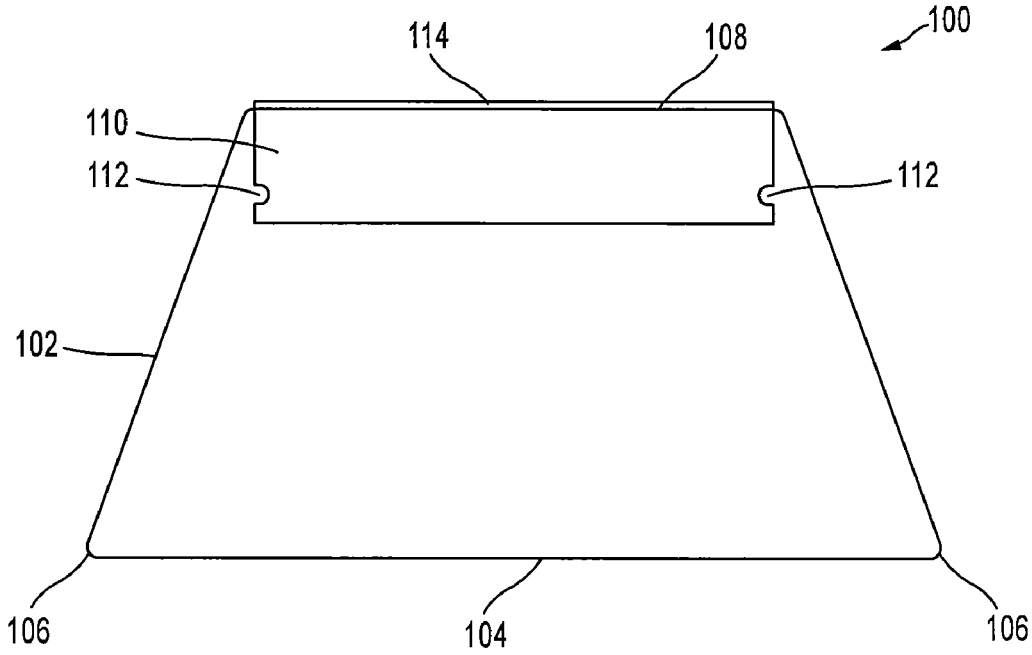
FIG. 1 is schematic (top-view) diagram illustrating a desk surface with a deployable book holder where the book holder is in the closed (or non-deployed) position.

Reference is now directed to the drawings, where like or similar elements are designated with identical or corresponding reference numerals throughout the several views. Referring to FIG. 1, illustrated is a desk 100 including a desk surface 102. In the illustrated embodiment of FIG. 1, the shape of the desk surface 102 is trapezoidal (a quadrilateral having one pair of parallel sides). More particularly, the shape is in the form of an isosceles trapezoid: a quadrilateral with a line of symmetry bisecting one pair of opposite sides, making it automatically a trapezoid; two opposite sides (bases) are parallel, the two other sides (legs) are of equal length, and the diagonals are of equal length. While the desk surface 102 of disclosed embodiment is in the form of an isosceles trapezoid, one skilled in the art will appreciate that there may be many other shapes of the desk surface 102. Such shapes include, without limitation, a rectangle, a square, a quadrilateral, a pentagon, a hexagon, and a triangle.

The desk surface 102 includes a proximal end 104, having rounded corners 106 to avoid injury from sharp, pointed corners. The desk surface also includes a distal end 108. In the illustrated embodiment, the proximal end 104 and the distal end 108 are parallel. The proximal end 104 is closest to where a user sits, and therefore the proximal end 104 is wider than the distal end 108 to provide adequate arm room for the user.

At the distal end 108 of the desk surface 102 is a deployable book holder 110. The deployable book holder 110 includes at least one pull tab 112 (two are illustrated in FIG. 1) to allow the user to manually deploy the book holder 110 when it is in the closed position, as illustrated in FIG. 1. Positioned adjacent to the distal end 108 of the desk surface 102 is a stopper mechanism 114 configured to stop the deployable book holder 110 at a predetermined angle relative to the desk surface 102, thereby enabling the deployable book holder 110 to support a book, such as a text book, at a desired angle. In this embodiment, the stopper mechanism 114 includes a wooden dowel rod; however, one skilled in the art will readily appreciate that many other suitable materials and shapes may be used to comprise the stopper mechanism. For example, hinges, straps, tethers, chains, and latches may all be used to comprise the stopper mechanism.

Figure 2:
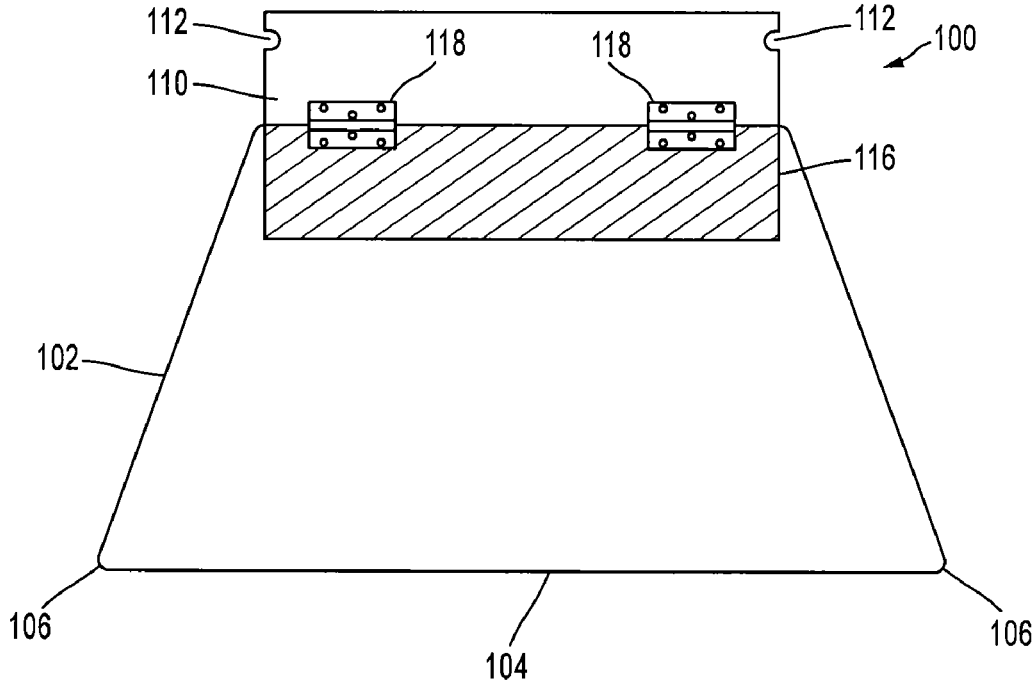
FIG. 2 is a schematic diagram (top-view) illustrating the desk surface with the deployable book holder of FIG. 1 where the book holder is in the open (or deployed) position, illustrating a first hinge-based mechanism for connecting the deployable book holder to the desk surface.

Referring now to FIG. 2, the same embodiment of the desk 100 as illustrated in FIG. 1 is shown; however the deployable book holder 110 is in the open, or deployed, position. The desk surface 102 includes a recess 116 into which the deployable book holder 110 fits when the deployable book holder 110 is in the closed position. Advantageously, the recess 116 includes a rubber surface to avoid slipping of the bottom edge of a book (such as a text book) when the book is being held up with the deployable book holder 110. While rubber is used in the disclosed embodiment, one skilled in the art would readily appreciate that other materials suitable for creating an acceptable level of frictional resistance to avoid slippage of a book may be used without deviating from the sprit of this disclosure. In the illustrated embodiment of FIG. 2, the deployable book holder 110 is connected to the desk surface 102 by two hinges 118; however, one skilled in the art will recognize that other means of securing the deployable book holder 110 to the desk surface 102, such as employing a rotatable tongue and groove assembly, may be used to accomplish this function. In this embodiment and the ones below, the recess 116 also serves as a pencil holder when the book holder 110 is in the open (deployed) position.

Figure 3:
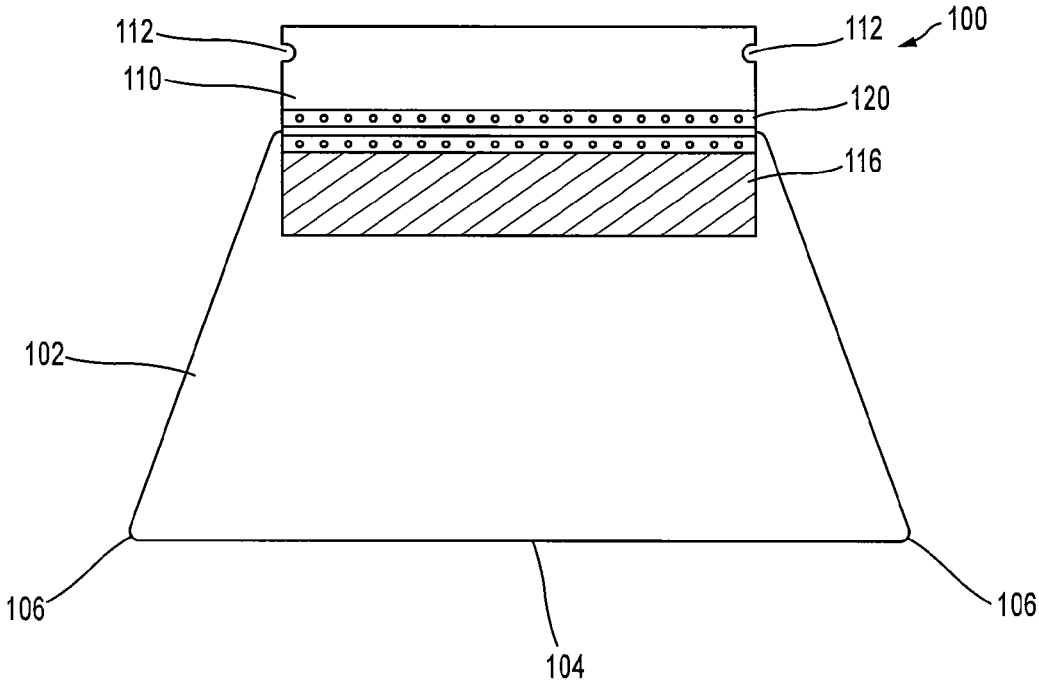
FIG. 3 is a schematic diagram (top-view) illustrating the desk surface with the deployable book holder of FIG. 1 where the book holder is in the open (or deployed) position, illustrating an alternative hinge-based mechanism for connecting the deployable book holder to the desk surface.

Referring to FIG. 3, an alternative embodiment of the desk 100 is shown with the deployable book holder 110 in the open, or deployed, position. In the embodiment illustrated in FIG. 3, a single hinge 120 is used to connect the deployable book holder 110 to the desk surface 102. One skilled in the art will readily appreciate that there are numerous other means by which the deployable book holder 110 may be connected to the desk surface 102 without deviating from the spirit of this disclosure or the scope of the claims herein.

Figure 4:
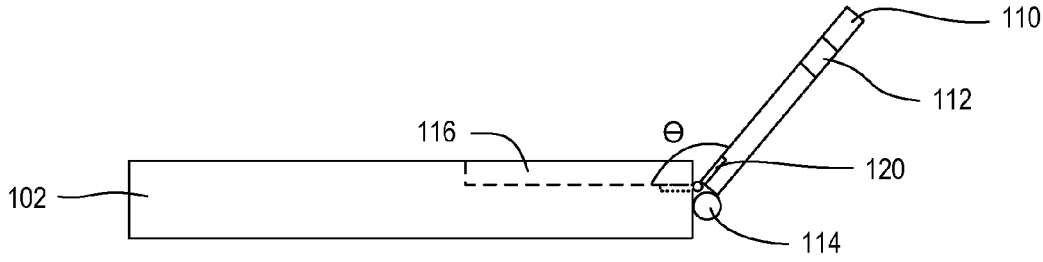
FIG. 4 is a schematic diagram (side view) illustrating a mechanism to stop the deployed book holder at a predetermined angle.

FIG. 4 depicts a side view illustration of the desk 100, with the deployable book holder 110 in the open, or deployed, position. As described above with reference to FIG. 3, the deployable book holder 110 is attached to the desk surface 102 by a hinge 120. In the deployed position, the deployable book holder 110 is stopped at a predetermined angle θ relative to the desk surface 102 by the stopper mechanism 114. In this embodiment, the predetermined angle θ is approximately 120 degrees; however, one skilled in the art will readily recognize that the deployable book holder 110 may be configured to open at any predetermined angel θ that is suitable for holding a book in place such that the user may easily read the book. Typically the angle θ falls within the range of angles between 90 degrees and 180 degrees. The stopping mechanism 114 is secured to the distal end 108 of the desk surface 102 with a plurality of screws. However, one skilled in the art will readily appreciate that many other means of securing the stopping mechanism 114 to the desk surface 102, such as for example nails, glue, rods, and welding, may be employed without deviating from the spirit of the disclosure or the scope of the claims herein.

Figure 5:
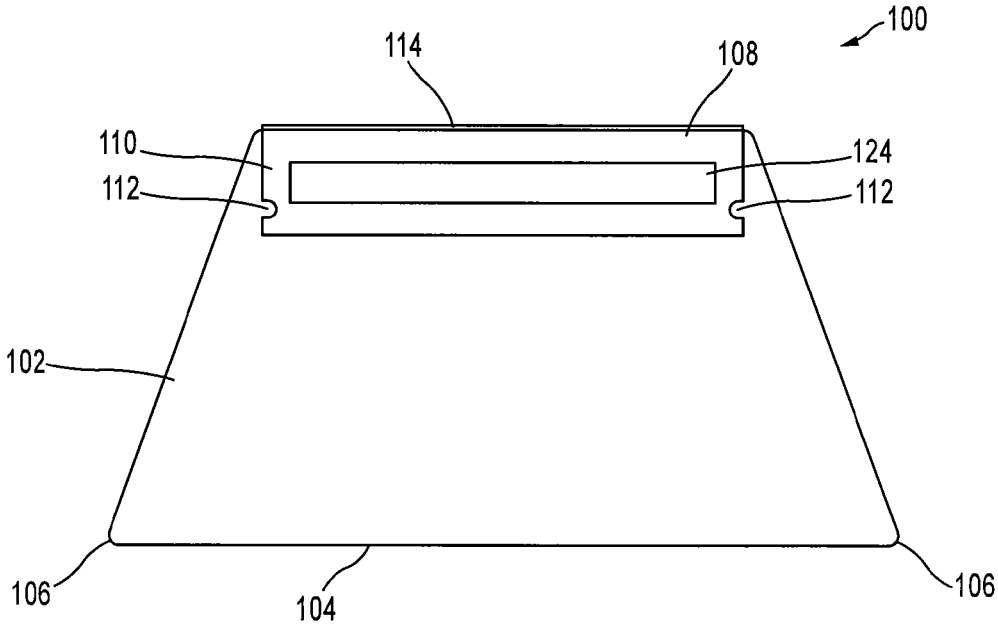
FIG. 5 is schematic (top-view) diagram illustrating an alternate embodiment of a desk surface with a deployable book holder, where the book holder is in the closed (or non-deployed) position.
Figure 6:
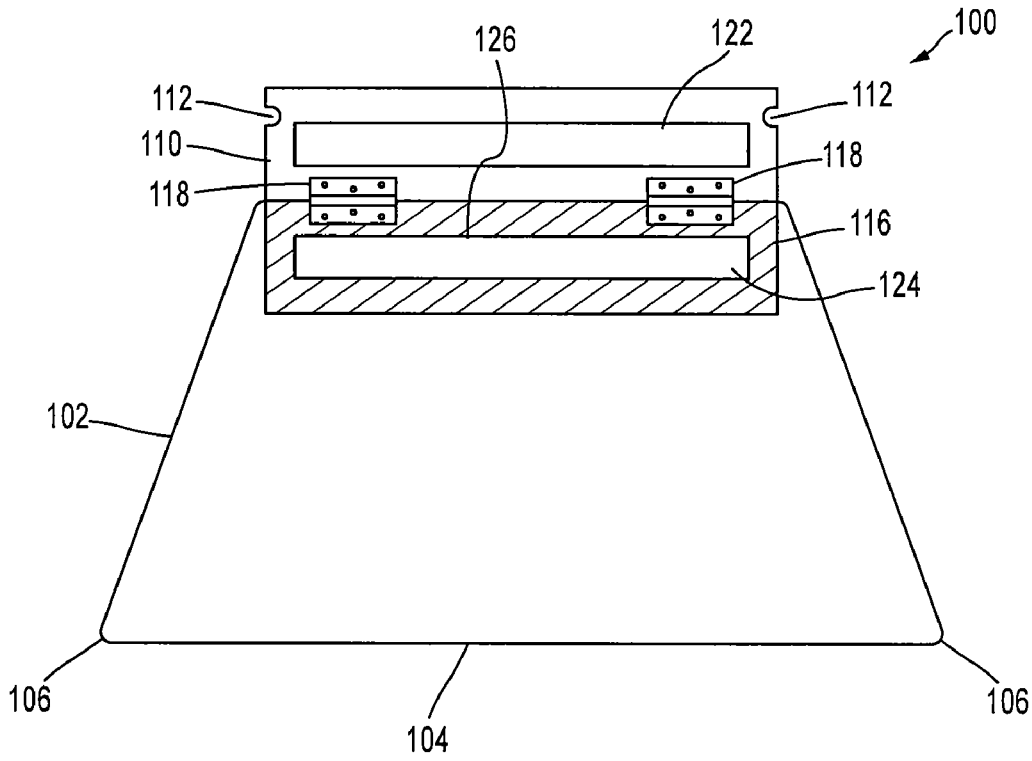
FIG. 6 is a schematic diagram (top-view) illustrating the desk surface with a deployable book holder of FIG. 5, where the book holder is in the open (or deployed) position.

Referring now to FIGS. 5 and 6 together, illustrated is an alternative embodiment of desk 100 in which the deployable book holder 110 includes an aperture 122, and in which the recess 116 includes an island 124. When in the closed position, as illustrated in FIG. 5, the island 124 protrudes through the aperture 122 of the deployable book holder 110 to form a relatively flat and uniform desk surface 102. When the deployable book holder 110 is in the open, or deployed, position, as illustrated in FIG. 6, the island 124 physically protrudes above the recess 116, thereby providing a ledge 126 against which the bottom edge of a book, such as a text book, may rest securely. The ledge 126 may also serve to hold the pages of an open book by inhibiting undesired flipping of the pages.

Figure 7:
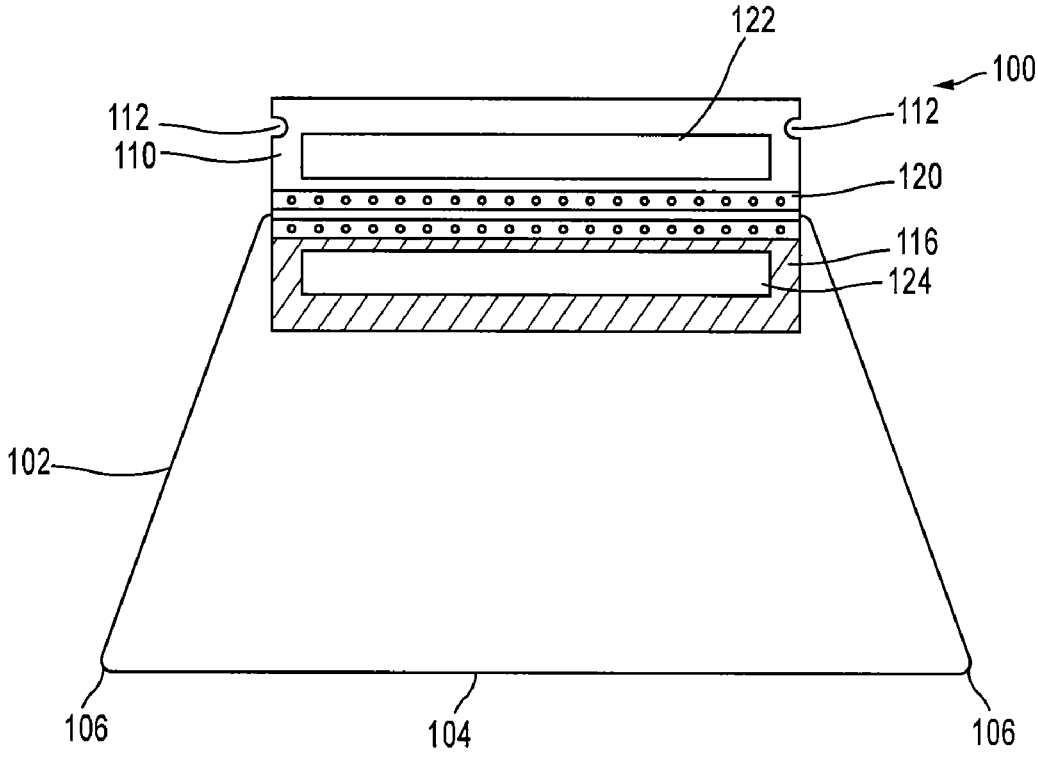
FIG. 7 is a schematic diagram (top-view) illustrating the desk surface with the deployable book holder of FIG. 5, where the book holder is in the open (or deployed) position, illustrating an alternative hinge-based mechanism for connecting the deployable book holder to the desk surface.

Referring to FIG. 7, an alternative embodiment of the desk 100 is shown with the deployable book holder 110 in the open, or deployed, position. In the embodiment illustrated in FIG. 7, a single hinge 120 is used to connect the deployable book holder 110 to desk surface 102.

Figure 8:
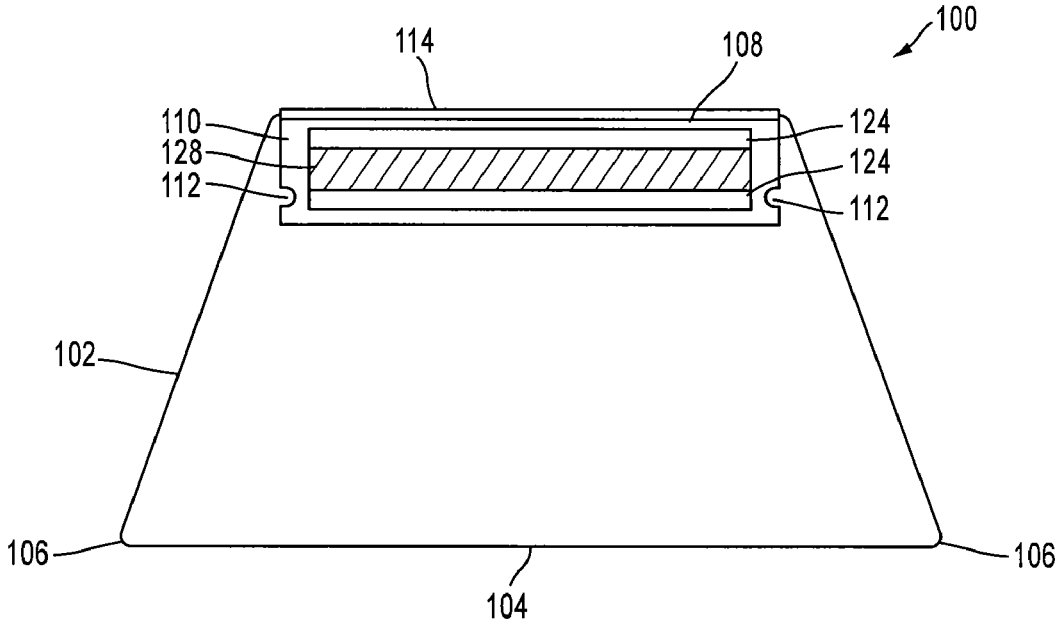
FIG. 8 is schematic (top-view) diagram illustrating an alternate embodiment of a desk surface with a deployable book holder, where the book holder is in the closed (or non-deployed) position.
Figure 9:
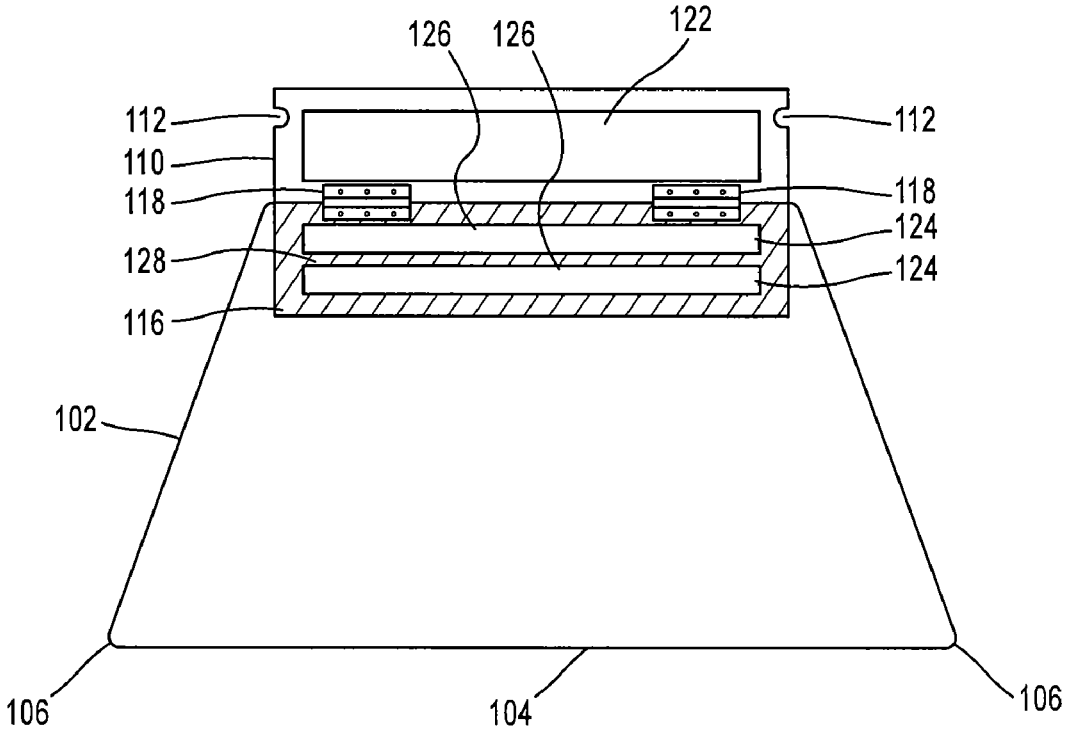
FIG. 9 is a schematic diagram (top-view) illustrating the desk surface with a deployable book holder of FIG. 8, where the book holder is in the open (or deployed) position.

Referring now to FIGS. 8 and 9 together, illustrated is an alternative embodiment of desk 100 in which the deployable book holder 110 includes an aperture 122, and in which the recess 116 includes two islands 124. When in the closed position, as illustrated in FIG. 8, the islands 124 protrude through the aperture 122 of the deployable book holder 110 to form a relatively flat and uniform desk surface 102, except a portion of the recess between the two islands 124 remains exposed to form a cavity 128 that may be used to hold items, such as, for example, pencils. When the deployable book holder 110 is in the open, or deployed, position, as illustrated in FIG. 9, the islands 124 physically protrude above the recess 116, thereby providing a plurality of ledges 126 against which the bottom edge of a book, such as a text book, may rest securely. The ledges 126 are at different distances from the distal end 108 of the desk surface 102 and the deployable book holder 110, thereby providing to the user different angles at which the user's book may be positioned against the deployable book holder 110. The ledges 126 may also serve to hold the pages of an open book by inhibiting undesired flipping of the pages.

Figure 10:
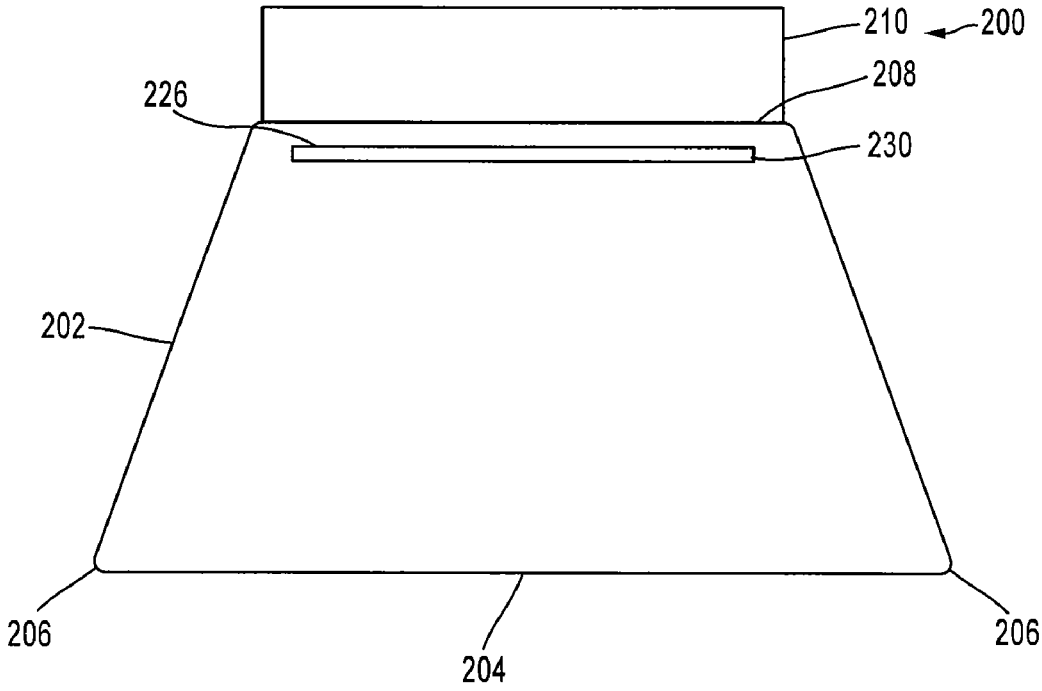
FIG. 10 is a schematic diagram (top-view) illustrating an alternate embodiment of a desk surface with a fixed book holder.

Referring to FIG. 10, illustrated is an alternative embodiment of desk 200 in which a book holder is in a fixed position relative to the desk surface 202.

Figure 11:
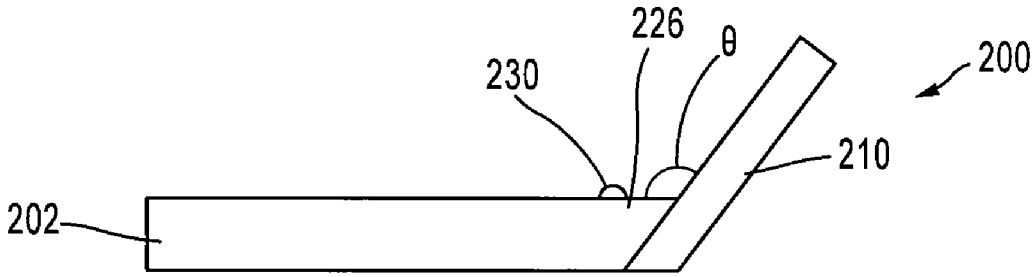
FIG. 11 is schematic diagram (side-view) illustrating the alternate embodiment of a desk surface with a fixed book holder of FIG. 10.

Referring to FIGS. 10 and 11, together, illustrated is a desk 200 including a desk surface 202. In the illustrated embodiment of FIG. 10, the shape of the desk surface 202 is trapezoidal. The desk surface 202 includes a proximal end 204, having rounded corners 206 to avoid injury from sharp, pointed corners. The desk surface also includes a distal end 208. In the illustrated embodiment, the proximal end 204 and the distal end 208 are parallel. The proximal end 204 is closest to where a user sits, and therefore the proximal end 204 is wider than the distal end 208 to provide adequate arm room for the user.

At the distal end 208 of the desk surface 202 is a fixed book holder 210 secured at a predetermined angle relative to the desk surface 202, thereby enabling the fixed book holder 210 to support a book, such as a text book, at a desired angle. The fixed book holder 210 may be secured to the desk surface 202 by any suitable mechanism, including without limitation, screws, nails, adhesive, welding, and interlacing joints (such as biscuit joints, dovetail joints, box joints, dado joints, domino joints, dowel butt joints, finger joints, lap joints, locked rabbet joints, miter joints, mortise and tenon joints, pocket hole joints, and spline joints).

A stopper 230 is positioned on the desk surface 202 near the distal end 208 of the desk surface 202. The stopper 230 protrudes from to the desk surface 202 to form a ledge 226 against which the bottom edge of a book, such as a text book, may rest securely. The ledge 226 also serves to hold the pages of an open book by inhibiting undesired flipping of the pages. In an alternative embodiment (not shown in FIG. 10), the stopper 230 includes a rubber surface to avoid slipping of the bottom edge of a book (such as a text book) when the book is being held up with the fixed book holder 210. While rubber is used in the disclosed alternative embodiment, one skilled in the art would readily appreciate that other materials suitable for creating an acceptable level of frictional resistance to avoid slippage of a book may be used without deviating from the sprit of this disclosure.

FIG. 11 depicts a side view illustration of the desk 200, with the fixed book holder 210. The fixed book holder 210 is positioned at a predetermined angle θ relative to the desk surface 202. In this embodiment, the predetermined angle θ is approximately 120 degrees; however, one skilled in the art will readily recognize that the fixed book holder 210 may be configured to be at any predetermined angel θ that is suitable for holding a book in place such that the user may easily read the book. Typically the angle θ falls within the range of angles between 90 degrees and 180 degrees.

While various embodiments have been illustrated and described, it is not intended that these embodiments illustrate and describe all possible forms of the technologies disclosed herein. Rather, the words used in the specification are words of description rather than limitation, and it is understood that various changes may be made without departing from the spirit and scope of the technologies disclosed herein.

What is claimed is:

1. A desk comprising:

a desk surface that comprises an island defined by a surrounding recess that extends to a depth below the desk surface; and a deployable book holder that comprises an aperture, the deployable book holder rotatably connected to a surface of the desk and having a fixed axis of rotation for a limited degree of rotation between a closed position and an open position with respect to the desk surface wherein, for the closed position, the depth of the recess accommodates the deployable book holder and the aperture of the deployable book holder accommodates the island to form a relatively flat desk surface and wherein, for the open position, a portion of the deployable book holder extends a distance above the desk surface for holding a book.

2. The desk of claim 1 wherein the desk surface comprises:

a proximal end having a first length;

a distal end having a second length; and wherein the length of the proximal end is greater than the length of the distal end, and wherein the proximal end and distal end are parallel to each other.

3. The desk of claim 1 wherein the desk surface comprises a trapezoidal shape.

4. The desk of claim 1 wherein the desk surface comprises an isosceles trapezoidal shape.

5. The desk of claim 1 further comprising a hinge that defines the fixed axis of rotation wherein the hinge rotatably connects the deployable book holder to the surface of the desk.

6. The desk of claim 1 further comprising a stopping mechanism connected to a distal end of the desk and positioned to limit the degree of rotation of the deployable book holder relative to the desk surface.

7. The desk of claim 6 wherein the limited degree of rotation of the book holder relative to the desk surface is limited to an angle between 90 degrees and 180 degrees.

8. The desk of claim 6 wherein the stopping mechanism comprises a rod.

9. The desk of claim 1 wherein a surface of the desk that defines, in part, the recess is configured to hold an edge of a book by force of friction when the deployable book holder is in the open position.

10. The desk of claim 9 wherein the surface comprises a rubber surface.

11. The desk of claim 1 wherein:

the desk surface comprises a plurality of islands defined by the recess;

the deployable book holder further comprises a plurality of apertures wherein the apertures and the islands are configured relative to each other such that the islands fit into the apertures when the deployable book holder is in a closed position.

* * * * *